US005964155A

United States Patent [19]

Platsch

[11] Patent Number: 5,964,155

[45] Date of Patent: Oct. 12, 1999

[54] DEVICE FOR POWDERING PRINTED PRODUCTS

[76] Inventor: Hans Georg Platsch, Kupferstr. 40, Stuttgart, Germany

[21] Appl. No.: 08/894,036

[22] PCT Filed: Nov. 14, 1996

[86] PCT No.: PCT/EP96/04995

§ 371 Date: Aug. 6, 1997

§ 102(e) Date: Aug. 6, 1997

[87] PCT Pub. No.: WO97/25207

PCT Pub. Date: Jul. 17, 1997

[30] Foreign Application Priority Data

Jan. 3, 1996 [DE] Germany ..... 196 00 075

[51] Int. Cl.[6] ..... B41F 35/00

[52] U.S. Cl. ..... 101/424.2; 101/419

[58] Field of Search ..... 101/424.2, 416.1, 101/424.1, 419, 420; 118/308, DIG. 1

[56] References Cited

U.S. PATENT DOCUMENTS

| | | | |
|---|---|---|---|
| 2,138,178 | 11/1938 | Lang | 340/660 |
| 2,394,656 | 2/1946 | Beregh | 101/424.2 |
| 3,275,196 | 9/1966 | Warczak | 406/681 |
| 4,033,294 | 7/1977 | Charland et al. | 118/658 |
| 4,452,174 | 6/1984 | Fedder | 118/689 |
| 4,807,528 | 2/1989 | Schmoeger et al. | 101/424.2 |
| 4,867,063 | 9/1989 | Baker et al. | 101/424.2 |
| 5,163,370 | 11/1992 | Platsch | 101/424.2 |
| 5,456,178 | 10/1995 | Henn et al. | 101/420 |
| 5,713,285 | 2/1998 | Reed et al. | 101/424.2 |

*Primary Examiner*—Edgar Burr
*Assistant Examiner*—Anthony H. Nguyen

[57] ABSTRACT

For powdering printed products it is proposed that they be moved through a nip formed by a powder application roller (38) and a support roller (32). Those two rollers have axial circumferential recesses (52, 54) which are each able to receive at least part of a gripper rod (24) moving a printed product and which are synchronized with the movement of a gripper rods. At a location upstream of the nip in the direction of rotation, powder is applied to the circumferential surface of the application roller (38) by a nozzle strip (62), which powder is then transferred in the passage nip from the application roller to the printed products.

23 Claims, 9 Drawing Sheets

Figure 1:
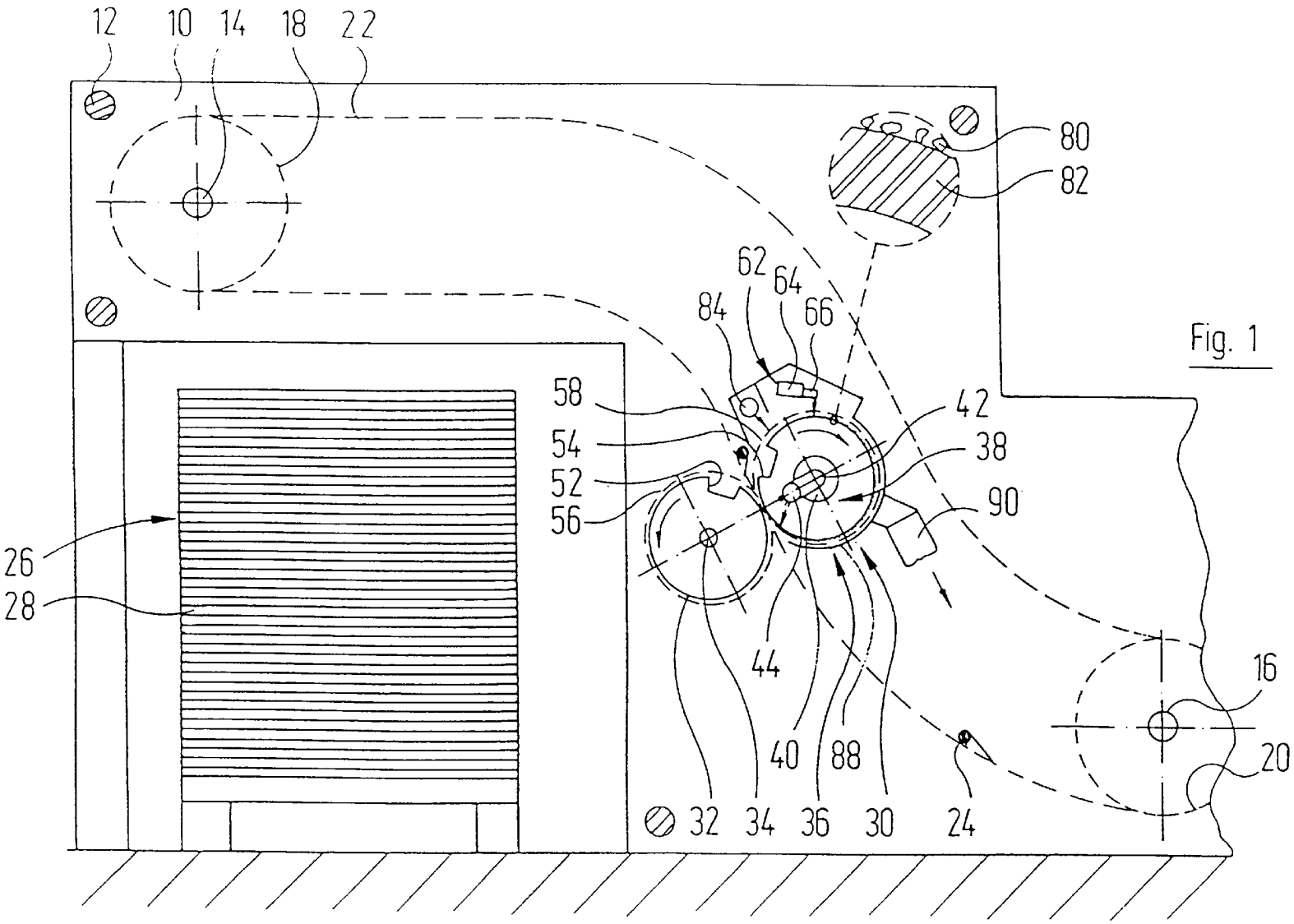

12
10
14
18
20
80
82
104
62
64
66
84
58
54
52
56
42
38
90
44
40
36
34
32
30
88
108
24
16
20
26
28

12
10
14
18
20
146
80
82
150
148
68
144
42
38
90
58
54
52
56
44
40
88
30
36
34
32
24
16
20
26
28

12
10
14
18
20
80
82
62
64
66
84
58
54
54'
58'
42
38
90
30'
38'
16
20
24
30
88
36
40
44
26
28

DEVICE FOR POWDERING PRINTED PRODUCTS

The invention relates to an apparatus for powdering printed products according to the precharacterising clause of claim 1.

In known powdering apparatus of that kind, the metered powder stream delivered from the powder reservoir is distributed in a carrier gas stream, and the powder mist so produced is fed to a nozzle strip extending transversely across the path over which the printed products are conveyed.

Owing to the gripper rods which move the printed products, that nozzle strip has to be arranged at a correspondingly large distance away from the conveying surface of the printed products. That is disadvantageous inter alia because a proportion of the powder mist produced escapes into the printing machine. In addition, only some of the powder particles directed towards the printing inks cling to the printing inks which have not yet dried completely.

By means of the present invention an apparatus according to the precharacterising clause of claim 1 is to be so developed that improved efficiency in the distribution of the metered powder stream over the surface of the printed products is achieved therewith.

That problem is solved according to the invention by a powdering apparatus having the features mentioned in claim 1.

In the case of the powdering apparatus according to the invention, powder particles are applied by a powder feeding element to the surface of an application roller.

The application roller has a circumference corresponding to the distance between successive gripper rods and is furthermore provided with a recess which is able to receive a gripper rod. The movement of the application roller is so synchronized with that of the gripper rods that gripper rods and recess arrive at the same time in the gap created between the application roller and the support element which supports the reverse side of the printed products. Since the application roller cooperates with the printed side of the printed products in a frictional connection, powder particles held on the circumferential surface of the application roller are transferred to the printed products very effectively. Since the feeding element, which in turn applies the powder particles to the circumferential surface of the application roller, is arranged outside the path of the gripper rods, it is not necessary to provide a large gap between its outlet end and the circumferential surface of the application roller.

The powdering apparatus according to the invention therefore operates very reliably with reduced powder consumption and with a reduction in the surrounding portions of the printing machine.

Advantageous developments of the invention are indicated in subclaims.

With the development of the invention according to claim 2, especially gentle transport of the printed products in the region of the application roller is obtained. In addition, the perpendicular force prevailing in the nip and acting on the printed products can be selected to be greater than when the reverse side of the printed products is supported by a plate-shaped stationary support element with sliding friction.

The development of the invention according to claim 3 is also advantageous with regard to exerting a relatively high application force of the powder particles.

As a result of the development of the invention according to claim 5, the printed products do not have to travel through sharp curves in the region of the powdering apparatus.

The development of the invention according to claim 6 is advantageous with regard to removing small residual amounts of powder which become detached from the surface of the application roller on the way between the feeding element and the nip between the application roller and the support element and of powder particles that are not properly transferred from the feeding element to the application roller.

The development of the invention according to claim 7 ensures that, between the feeding element and the path of the application roller between the application roller and the support element, the circumferential surface of the application roller is surrounded with a small clearance, which is similarly advantageous with regard to avoiding the escape of powder particles.

As a result of the development of the invention according to claim 8, the powder particles are held non-positively on the circumferential surface of the application roller.

The development of the invention according to claim 9 provides the advantage that the powder particles held by the application roller are reliably released from the surface of the roller and transferred to the printed products at the nip.

The development of the invention according to claim 10 allows the application roller to be coated with powder particles very evenly utilising the proven technology used for direct dusting of printed products.

The alternative for applying powder particles to the circumferential surface of the application roller given in claim 11 has the advantage that the particles are applied mechanically and there is no outflowing carrier gas carrying a residue of powder particles with it. A further advantage of the apparatus according to claim 11 is that, when coating the outer surface of the application roller with powder particles, any residual amounts of powder particles are taken into account, in other words a transfer of the powder particles carried by the application roller to the printed products that is only partial, as is desirable in special applications, does not lead to local double coating of the application roller when the surface regions coated with the residue pass by the feeding element again.

In a powdering apparatus according to claim 12, there is improved sealing of the feeding element with respect to the downstream region of the apparatus.

As a result of the development of the invention according to claim 13, in the case of polarisable or chargeable powder particles an improved transfer thereof from the feeding element to the circumferential surface of the application roller is obtained.

The development of the invention according to claim 14 allows a targeted partial coating of the printed products with powder particles. Regions of the printed products where there is no fear of sticking to neighbouring sheets of a stack can therefore remain uncoated.

The development of the invention according to claim 15 allows the powder-coated regions and the powder-free regions of the printed products to be specified in a simple manner.

Determination of the powder pattern on the surface of the printed products can be carried out simply automatically if the printing ink distribution on the printed product is measured with a sensor strip, as specified in claim 16, and the output signals of that sensor strip are used to produce the control signals stored in the pattern memory, which control signals actuate the individual feeding element segments.

The development of the invention according to claim 17 not only allows printed and unprinted surfaces to be distinguished but also (for example by reference to the ink) allows those regions that carry two or more layers of ink to be distinguished from regions printed with only a single layer of ink. In many printed products it may be sufficient not to powder the regions covered with only a single layer of ink if those regions are only relatively small in size and are thus spaced in any case from a neighbouring printed sheet by neighbouring, higher multiple-ink regions.

The development of the invention according to claim 18 also serves to powder the printed products in regions in a controlled manner.

The development of the invention according to claim 19 allows both sides of the printed products to be equally powdered. Powdering of the printed products on two sides can sometimes be more advantageous than a thick one-sided powdering of only one surface of a printed product that is printed on both sides since, in that way, both sides are treated symmetrically and are thus exactly the same in feel and in shine.

Figure 2:
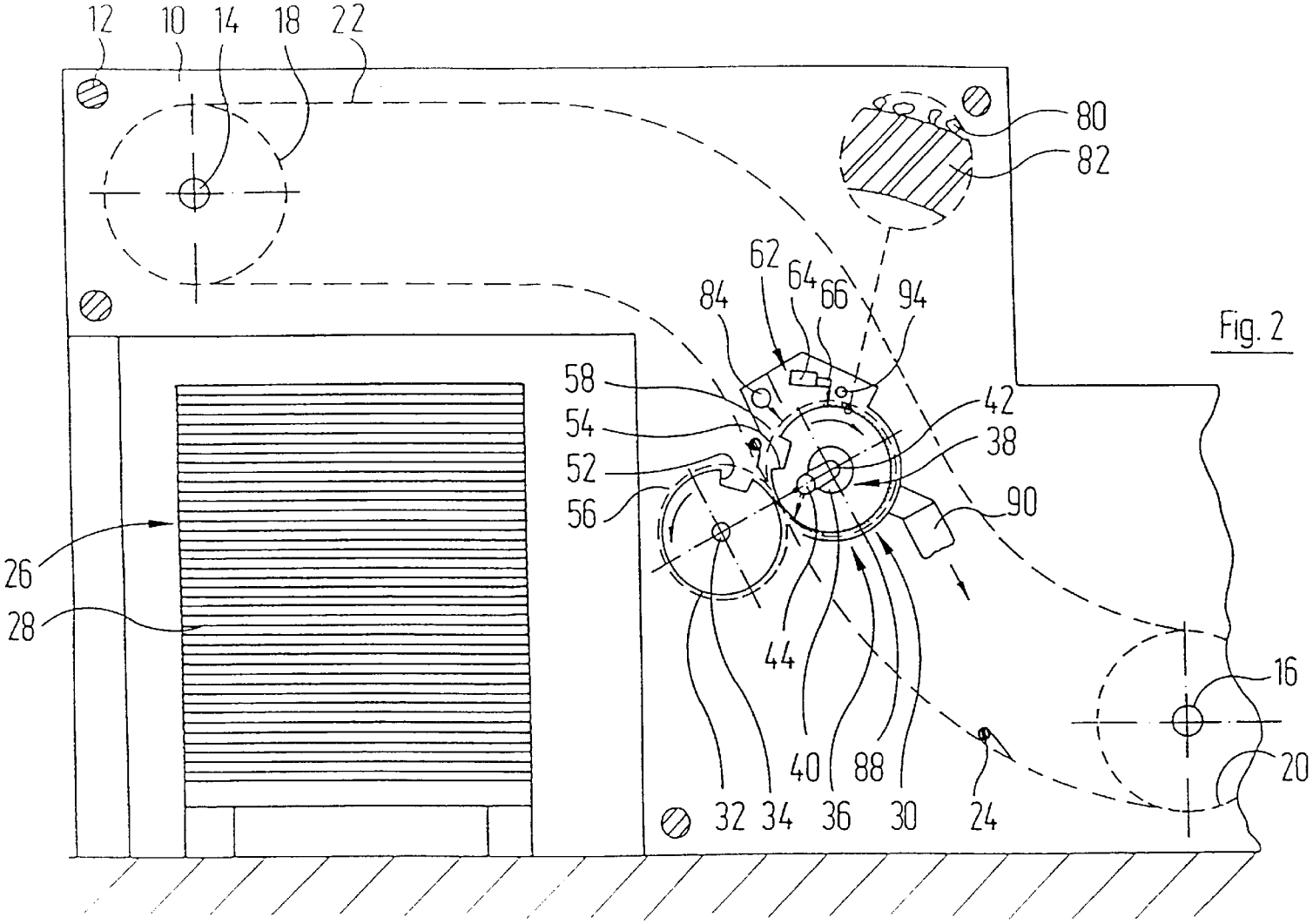
Figure 3:
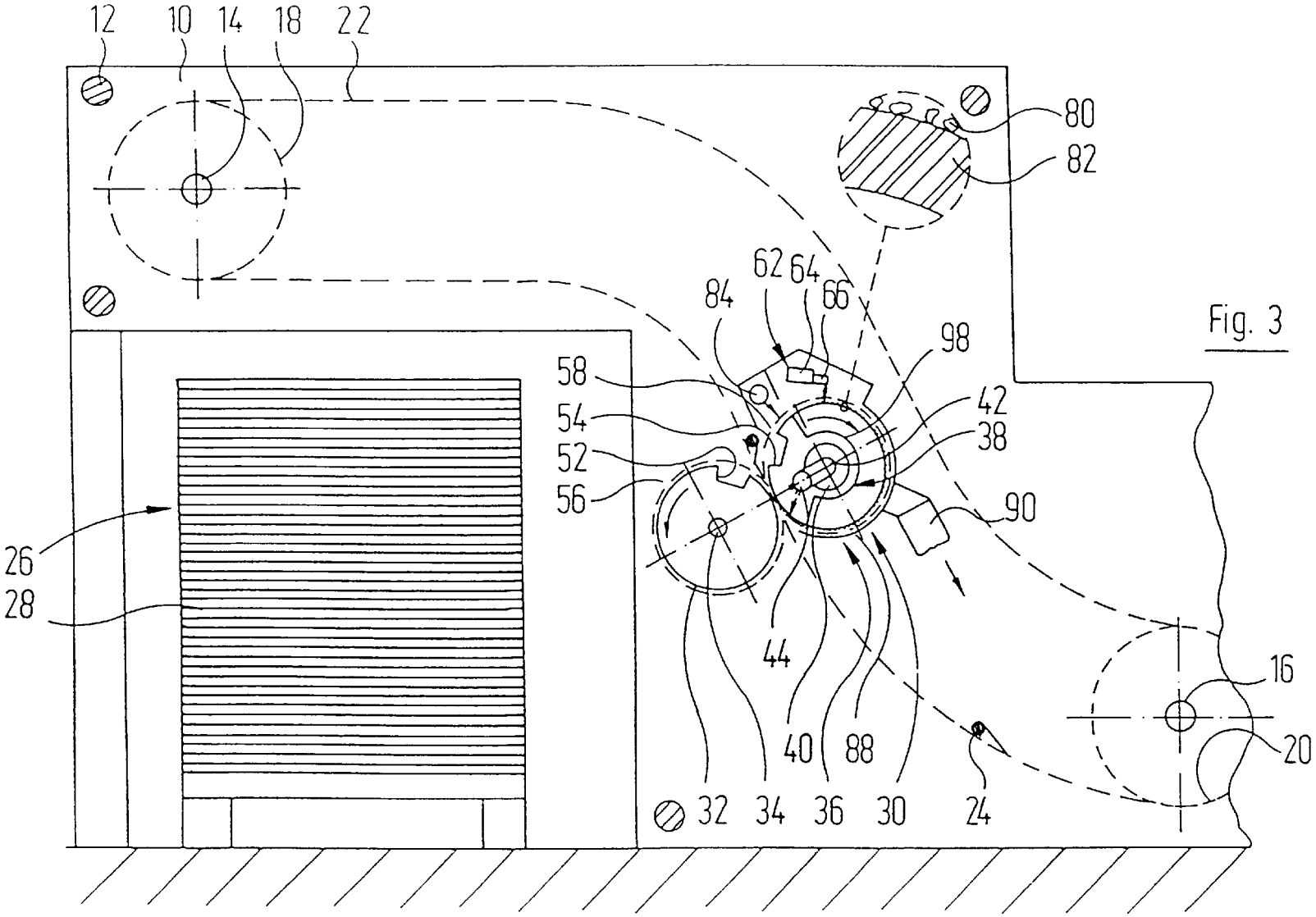
Figure 4:
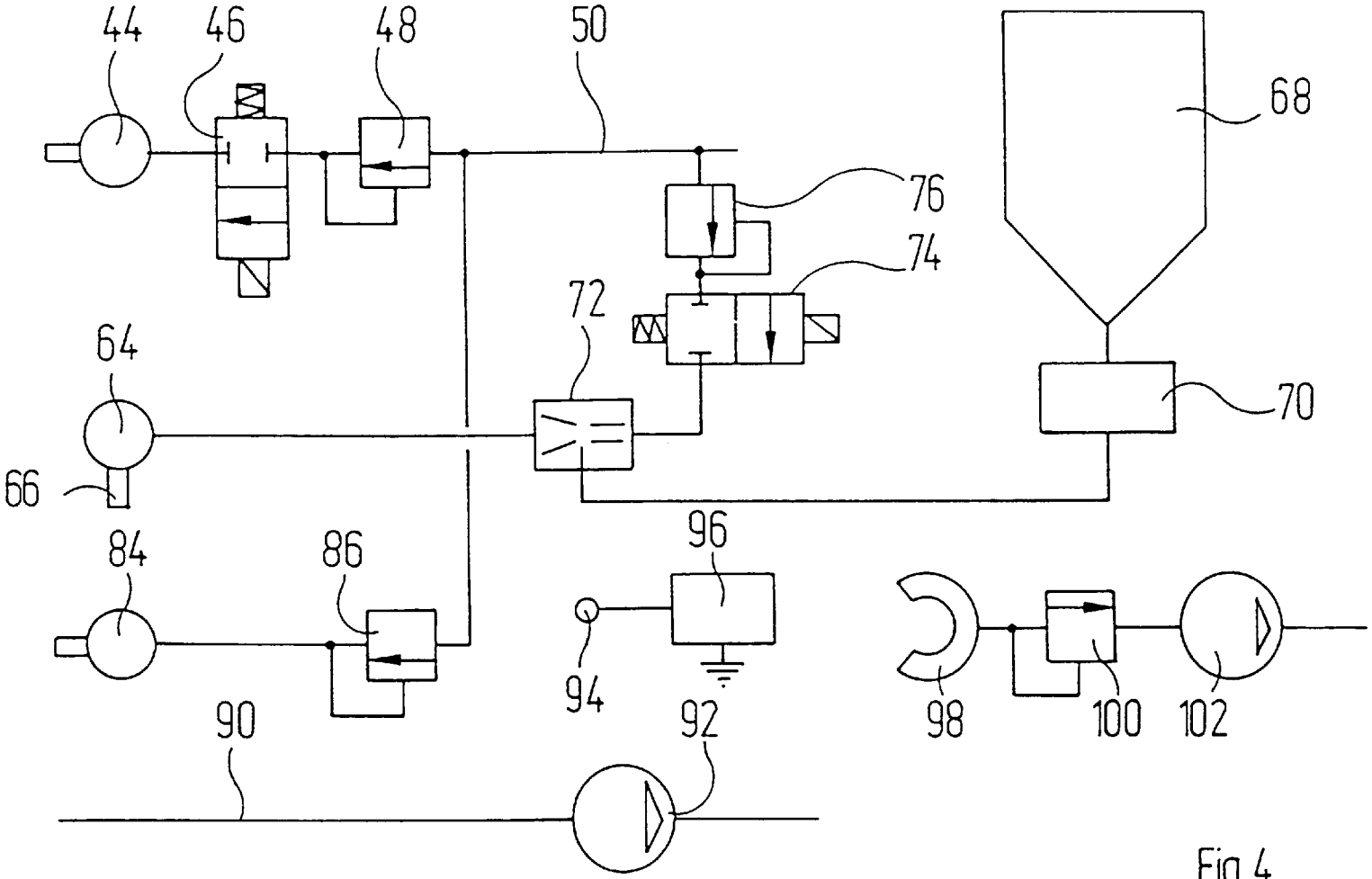
Figure 5:
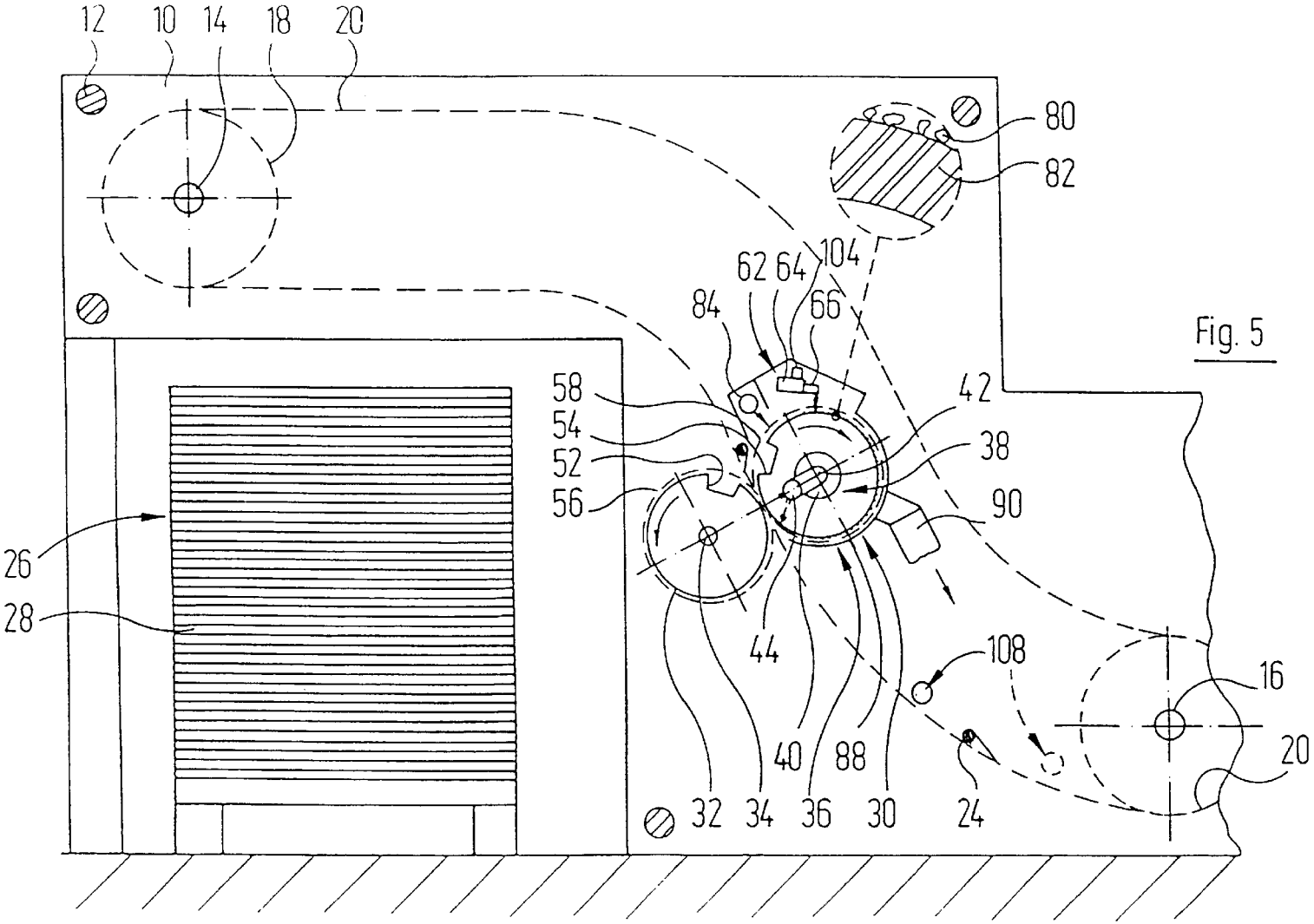
Figure 6:
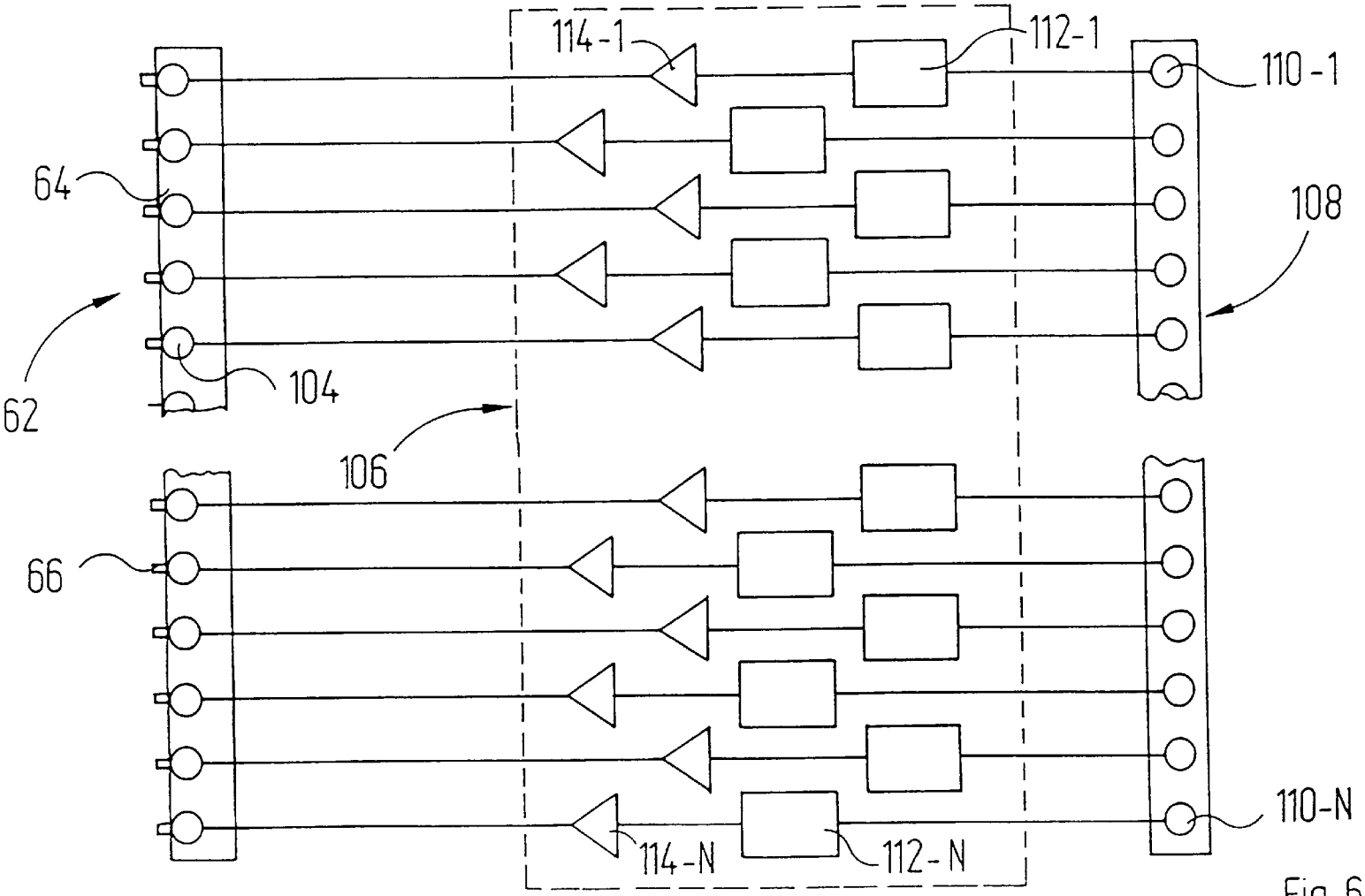
Figure 7:
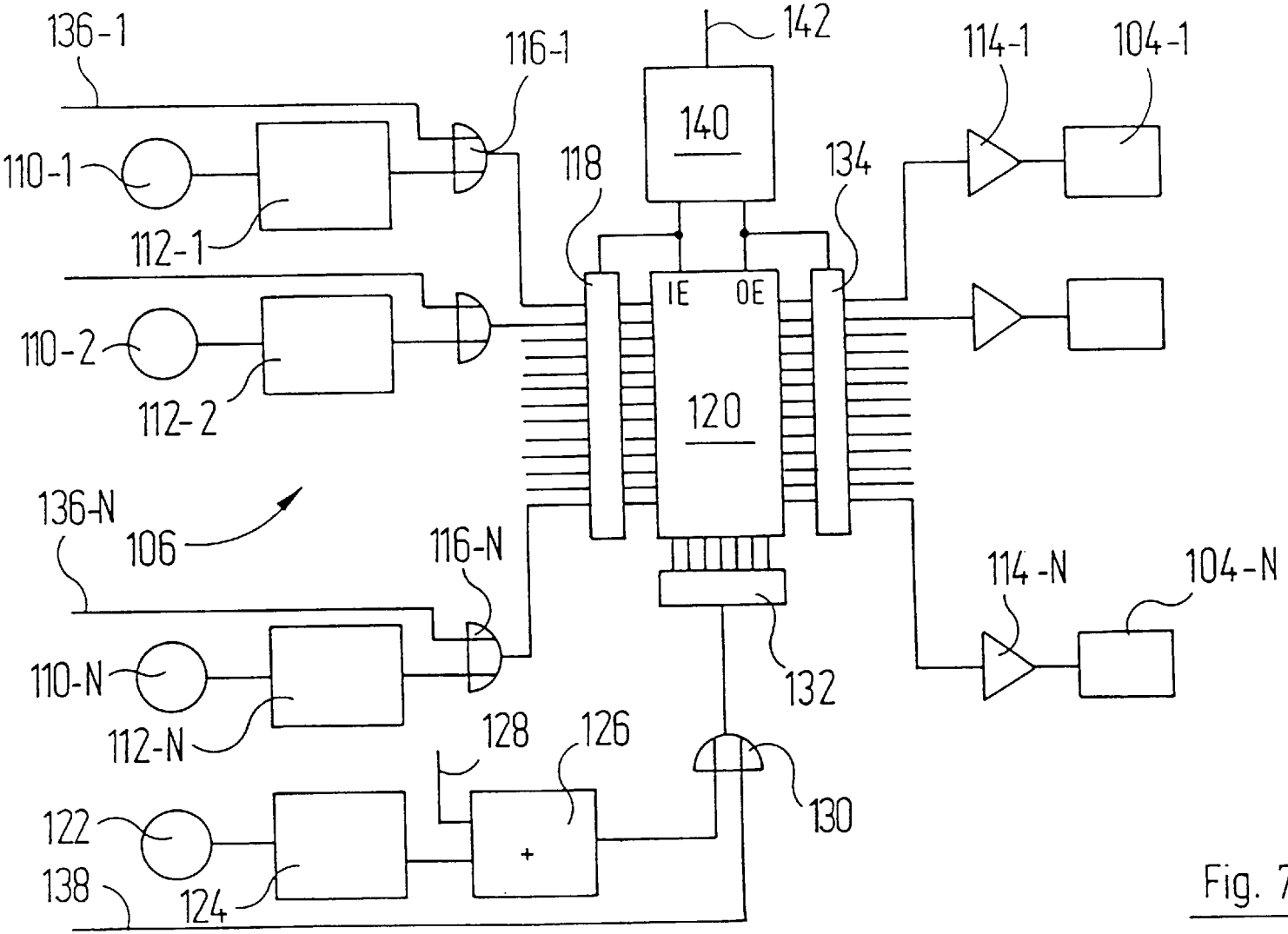
Figure 8:
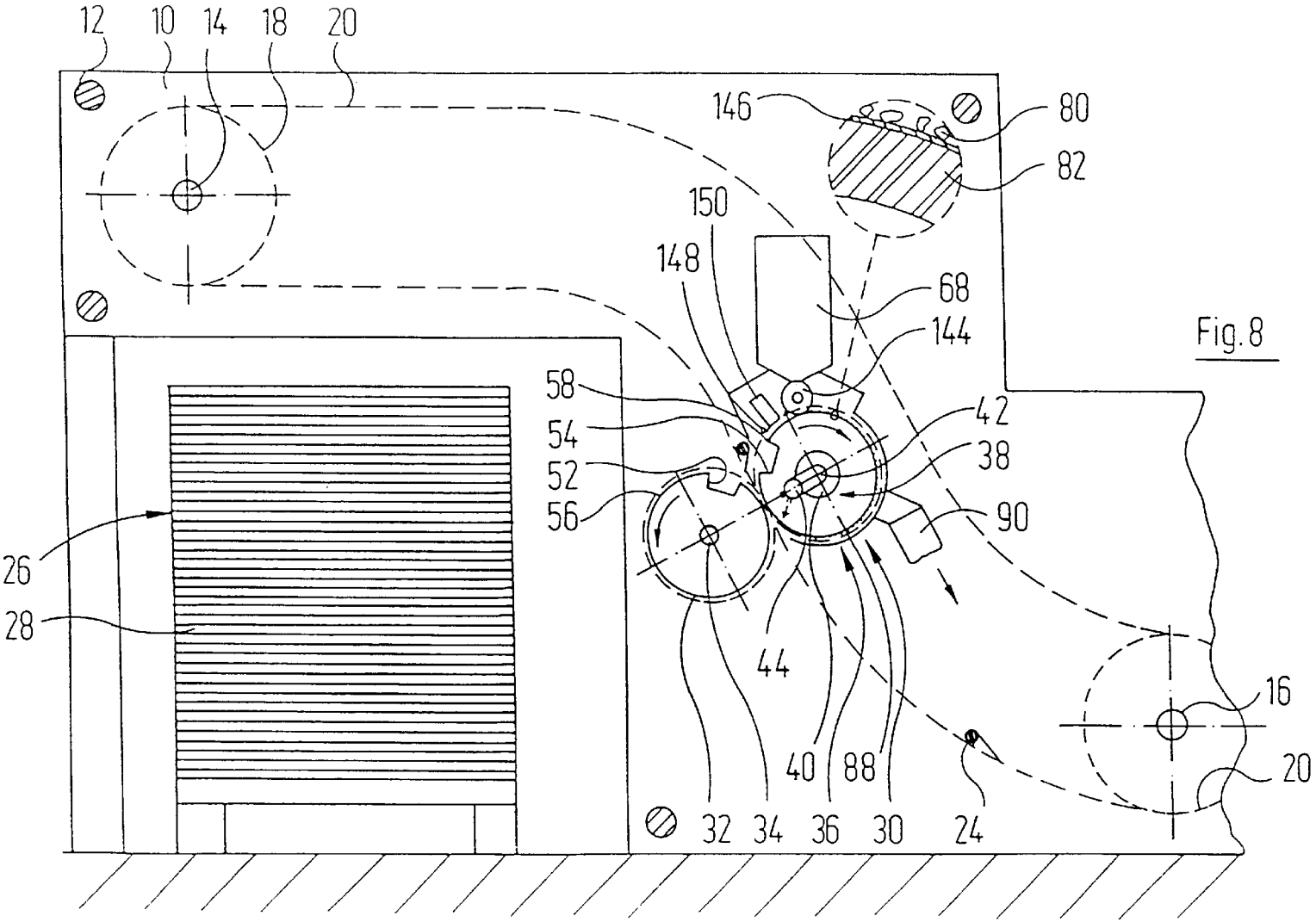
Figure 9:
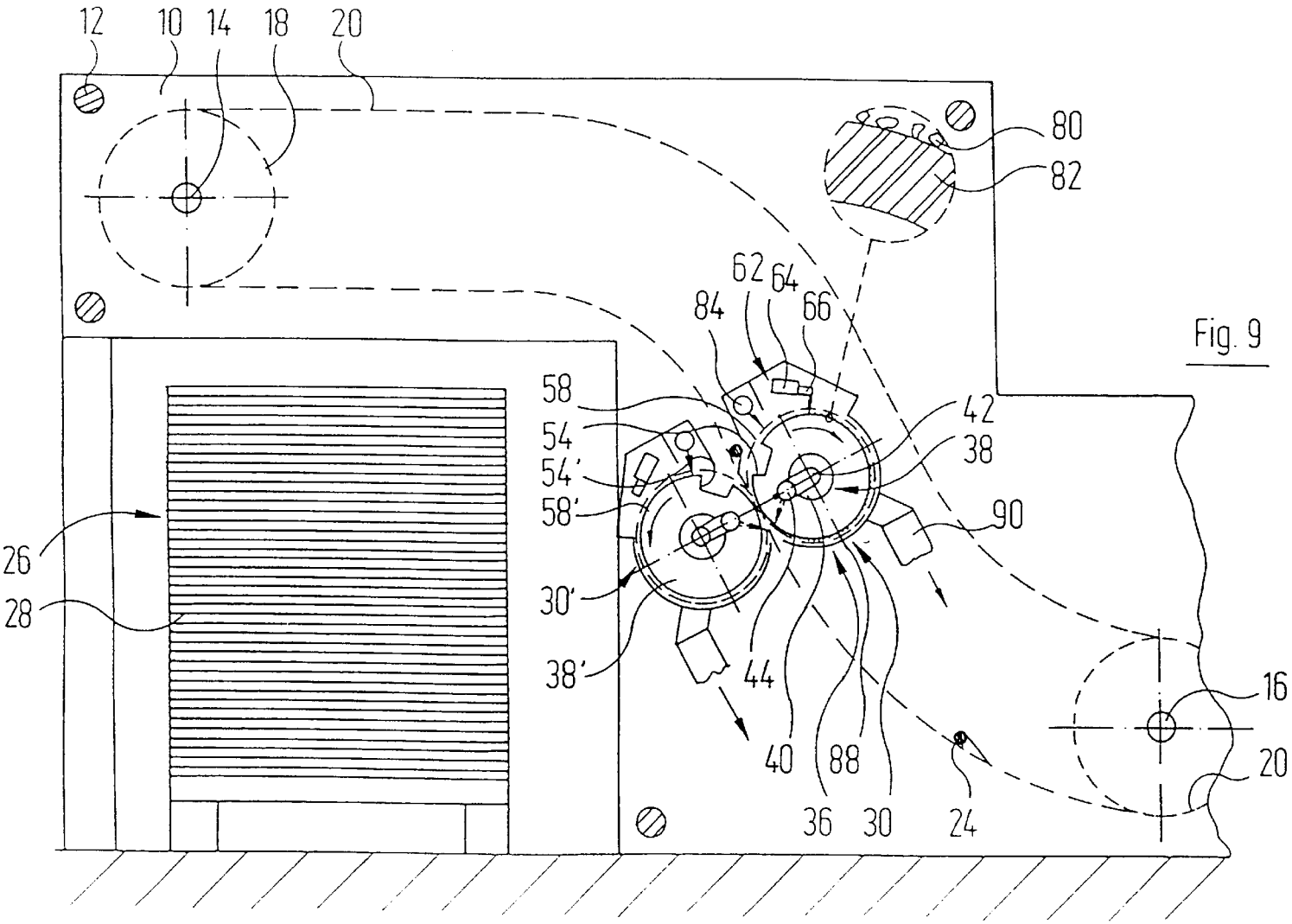

The invention is described in detail below with the aid of illustrative embodiments and with reference to the drawings, in which:

FIG. 1: shows a longitudinal schematic section through the outlet end of a printing machine in which dusting of the printed products with powder takes place;

FIGS. 2 and 3: are each a view similar to FIG. 1, showing a modified apparatus for powdering printed products;

FIG. 4: is a schematic view of the connection of various parts of the apparatus shown in FIGS. 1 to 3 to supply units;

FIG. 5: is a view similar to FIG. 1, showing a modified apparatus for powdering printed products;

FIG. 6: is a circuit diagram of a control unit for a controllable powder feeding element of the apparatus shown in FIG. 5;

FIG. 7: is a circuit diagram of a modified control unit for a controllable powder feeding element of the apparatus shown in FIG. 5; and FIGS. 8 and 9: are views similar to FIG. 1, showing further, modified apparatuses for powdering printed products.

A printing machine, of which only the end section at the outlet side is shown in FIG. 1, has lateral frame plates 10 which are connected by cross-members 12.

Supported in the frame plates 10 are axles 14, 16 each carrying two axially spaced chain wheels 18 and 20, respectively. Conveyor chains 22 which are correspondingly spaced apart in the axial direction and which carry at regular intervals gripper rods 24, of which only two are shown by way of example in FIG. 1, run over the chain wheels 18, 20. In the illustrated end section of the printing machine, the conveying path for the printed products takes an S-shaped course over a stacking station 26 on which the finished printed products are collected to form a stack 28.

In the ascending portion of the conveying path, a powder application head 30 is arranged at the printed side of the printed products. Provided opposite it, in relation to the conveying path of the printed products, is a support roller 32 which is supported in the frame plates 10 by means of a shaft 34.

The application head 30 has a housing 36 in which an application roller 38 rotates. The latter is supported in the frame plates 10 by means of a hollow shaft 40. Extending through the hollow shaft 40 in a sliding fit is a carrier pipe 42 which carries an eccentric blowing pipe 44 extending in the axial direction. The blowing pipe 44 is connected (see FIG. 4) via a 2/2 solenoid valve 46 and a pressure regulator 48 to a compressed air line 50.

An axial recess 52 is provided in the support roller 32; correspondingly, the application roller 38 has an axial recess 54. The recesses 52, 54 have a depth which is so calculated that they are able to receive a gripper rod 24 on their own if necessary. The circumferential length of the recesses 52, 54 corresponds to the size of a gripper rod 24 measured in the conveying direction, plus a safety margin.

The support roller 32 is rigidly connected to a toothed wheel 56 which cooperates with the underside of the conveyor chain 22. The application roller 38 is connected to a toothed wheel 58, which is shown in FIG. 1 as lying in the plane of the drawing but which, in reality, is offset from the plane of the drawing and meshes with the second conveyor chain which is not shown in the drawing. Accordingly, the support roller 32 and the application roller 38 are driven in opposite directions of rotation, the phase position of the two rollers being so adjusted that the recesses 52, 54 meet in the nip and enclose from both sides a gripper rod 24 running synchronously into the nip.

The application roller 38 is therefore able to run with a small amount of clearance or in frictional connection on the support roller 32.

Arranged in the housing 36 surrounding the application roller 38 is a nozzle strip 62 which comprises a distributor pipe 64 and a plurality of nozzles carried thereon.

A continuously adjustable stream of powder is delivered from a powder reservoir 68 by a metering device 70 which may, for example, include a plate vibrator. The stream of powder is fed to the one inlet of a mixer nozzle 72, the second inlet of which is connected via a 2/2 solenoid valve 74 and a pressure regulator 76 to a compressed air line 50. The outlet of the mixer nozzle 72, at which a powder mist stream is obtained, is connected to the inlet of the distributor pipe 64. Wisps of powder mist thus leave the delivery openings of the nozzle strip 62, which delivery openings face the circumferential surface of the application roller 38. The powder particles contained therein cling at least to some extent to the outer surface of the application roller 38, as is indicated in FIG. 1 at 80.

The adhesive power of the powder particles on the outer surface of the application roller 38 can be improved by making the circumferential wall of the application roller 38, shown at 82, from a suitable material, especially a plastics material, in which the powder particles (usually corn starch particles having an average particle diameter of about from 10 to 20 $\mu$m) adhere well.

In order to prevent powder mist from leaving from the downstream end section of the housing 36, a blowing strip 84 is provided upstream of the nozzle strip 62 viewed in the direction of rotation, which blowing strip is connected via a pressure regulator 86 to the compressed air line 50.

As can also be seen from FIG. 1, the housing 36 has in the portion thereof lying downstream of the nozzle strip 62 a wall part 88 that is coaxial with the hollow shaft 40 and extends at a small distance above the outer surface of the application roller 38. The downstream end of the circumferential wall 82 is sufficiently far away from the conveying surface through which the gripper rods 24 pass that the latter run unhindered past the end of the circumferential wall 82.

Approximately at the middle of the circumferential extent of the circumferential wall 82, a suction pipe 90 is connected to the housing 36, which suction pipe 90 is connected (see FIG. 4) to a suction fan 92. In that manner, the carrier gas of the mist still containing residual powder particles is sucked away and free powder particles not carried on the surface of the application roller 38 are prevented from leaving at the upstream end of the housing 36. The stream of air sucked in by the fan 92 and the partial vacuum thereby produced in the interior of the housing 36 is small, so that no powder particles are sucked off the surface of the application roller 38.

The powder particles reaching the nip are then transferred to the printing inks as they come into contact with the still tacky printing ink of the printed products, and pass on with the printed products, while the surface of the application roller 38, which is now free of powder particles again, returns to the nozzle strip 62 to be re-coated with powder.

In the modified illustrative embodiment of a powdering apparatus shown in FIG. 2, a wire electrode 94 is provided downstream of the nozzle strip 62 viewed in the direction of rotation, which electrode is connected (see FIG. 4) to one terminal of a high-voltage generator 96. The second terminal thereof is connected to the machine earth, to which the hollow shaft 40 is also connected. Normally, the electrode 94 is at positive potential and the field formed between the electrode 94 and the application roller 38 assists migration of the powder particles 80 towards the roller surface.

In the illustrative embodiment shown in FIG. 3, the circumferential wall 82 of the application roller 38 is made from a sintered material the pores of which are so dimensioned that no powder particles are able to enter the wall material but the wall as a whole is still air-permeable.

Arranged on the inside of the circumferential wall 82 is a suction box 98 which is connected (see FIG. 4) via a pressure regulator 100 to a suction machine 102. That connection is not shown in FIG. 3; it is made by a passage through the second end of the hollow shaft 40.

By applying a partial vacuum to the circumferential portion of the application roller 38 located between the nozzle strip 62 and the upstream end of the housing 36, good adherence of the powder particles to the roller surface is obtained. The application roller can therefore carry a greater amount of powder per unit area. After disconnecting the partial vacuum downstream of the rearward end of the suction box 98 viewed in the direction of rotation and as a result of the air delivered by the blowing pipe 44 an effective transfer of the powder particles from the application roller 38 to the printed products is ensured.

FIG. 5 shows a powdering apparatus derived from that shown in FIG. 1. For each of the nozzles 66 there is a provided a solenoid valve 104 which controls the connection between the nozzle and the distributor pipe 64. The various solenoid valves are connected to associated output terminals of a control unit 106 (see FIG. 6).

The control unit 106 operates in dependence upon the output signals of a sensor strip 108 which is arranged upstream of the powder application head 30, transversely across the conveying path of the printed products. The sensor strip 108 comprises a plurality of sensor elements 110, each of the sensor elements 110 lying in a plane that is parallel to the plane of the drawing and that passes through an associated one of the nozzles 66.

The sensor strip 108 lies at a distance in front of the nip formed by the support roller 32 and the application roller 38, which distance corresponds to the involute of that circumferential portion of the application roller 38 which lies between the nozzle strip 62 and the nip.

Owing to the synchronized movement of the application roller 38 and the conveyor chains 22, the portion of a printed product situated in the nip is therefore covered with those powder particles which were delivered by the nozzle strip 62 at the point in time when the corresponding surface region of the printed product was under the sensor strip 108.

The control unit 106 may therefore consist, as shown in FIG. 6, simply of discriminator circuits 112 which are associated with the individual sensor elements and which, in the simplest case, merely determine whether the surface region of the printed product lying under the sensor element is printed or not. More complicated discriminator circuits can examine whether the region of the surface of the printed product just being scanned by the associated sensor element has been printed with one, two or more printing inks.

The discriminator circuits 112 generate an output signal whenever analysis of the printing reveals that powdering is necessary in the surface region just tested. After being amplified in amplifiers 114, the output signal of the discriminator circuits 112 can then be used directly to actuate the solenoid valves 104.

In a modified illustrative embodiment, a modified control unit is used which makes it possible also to select a different position of the sensor strip 108, in addition to the specific position of the sensor strip shown in FIG. 5 by continuous lines which is coordinated with the position of the nozzle strip 62; that different position may arise from the necessity of arranging other elements, for example an additional drier, upstream of the powder application head 30. A sensor strip arranged in that manner is shown by broken lines in FIG. 5.

As can be seen from FIG. 7, the outputs of the discriminator circuits 112-1 to 112-N associated with the sensor elements 110-1 to 110-N (N=number of nozzles 66 of the nozzle strip 62) are for that purpose connected via first inputs of OR gates 116 to a read-in register 118 of a pattern memory 120. The number of memory cells is at least equal to the number obtained by dividing the length of a printed sheet by the length of the measuring region of a sensor element 110.

A rotary encoder 122 which is coupled to the hollow shaft 40 is connected to the input of an analogue-to-digital converter 124. The output thereof is connected to one input of a digital summing circuit 126 which receives at its second input via a line 128 a digital phase signal corresponding to the difference in the position of the sensor strip 108 at that point of the conveying path of the printed products which is the same distance away from the nip as is the nozzle strip 62. In the circumstances shown in FIG. 5, the phase signal corresponds to the difference in position between the sensor strip shown by solid lines and the sensor strip drawn in broken lines.

The output of the summing circuit 126 is connected to the one input of an OR gate 130 the output of which is connected to an address register 132 of the pattern memory 120.

The memory cells of the pattern memory 120 are further connected via a read-out register 134 to the inputs of the amplifiers 114-1 to 114-N.

The second inputs of the OR gates 116-1 to 116-N are connected to lines 136-1 to 136-N so that the pattern memory can also be filled directly by signals provided by a computer or read from a data carrier. When such data are read into the pattern memory 120, addressing is carried out via the second inputs of the OR gate 130 which is connected to a line 138.

Associated with the pattern memory 120 is a control circuit 140 which, in dependence upon a control signal transmitted via a line 142 from a main control unit, supplies a signal to a read-in activation terminal IE or to a read-out activation terminal OE.

The control system shown in FIG. 7 operates as follows:

In a first learning mode, the control signals generated by the discriminator circuits 112 on the basis of the output signals of the sensor elements 110 are stored, as addressed by the rotary encoder 122, in the pattern memory 120, the summing circuit 126 causing the stored signals in the pattern memory 120 to correspond to those obtained if the sensor strip 108 indicated by broken lines were in the position shown by solid lines in FIG. 5, that is to say were at the same distance from the nip as was the nozzle strip 62.

In a second type of learning mode, corresponding control signals are taken via the lines 136 and placed in the pattern memory as addressed by the signals on the line 142.

In order to powder printed products, the memory cells of the pattern memory 120 are read out as addressed by the rotary encoder 122, the higher ranking control system not shown in FIG. 7 ensuring that there is no signal on the line 128, so that the unaltered output signal of the analogue-to-digital converter 124 is obtained at the output of the summing circuit 126.

As a modification of the illustrative embodiment described above with reference to FIG. 5, it is also possible to provide (where appropriate in addition) a blowing pipe 44 having delivery nozzles that can be controlled in a similarly separate manner to the nozzles 66 of the nozzle strip 66. The delivery nozzles are then actuated in a manner similar to that described above for the nozzles 66 with reference to FIG. 6 or 7, but with the altered phase position with respect to the sensor strip being taken into account. In the modified illustrative embodiment of the powdering apparatus shown in FIG. 6, instead of a nozzle strip 72, a magnetic brush 144 similar to that used to apply toner particles to the drums of photocopiers and laser printers is provided.

The application roller 38 then carries on its circumferential wall, in addition, a light-sensitive layer 146. Provided upstream of the magnetic brush 144 is a corona wire 148 and a light-emitting diode strip 150. The individual light-emitting diodes or groups of light-emitting diodes of the light-emitting diode strip 150 are actuated in a manner similar to that described above for the solenoid valves 104.

The magnetic brush 144 is arranged at the slot-shaped lower delivery end of the powder reservoir 68 and takes powder particles from the latter, which powder particles are transferred by the magnetic brush 144 to the non-exposed portions of the layer 146 as is usual in photocopying. The powder-coated regions of the application roller 38 then deliver the powder particles to the printed products in the nip. An application roller of that kind is considerably larger in size than the photoconductive drum of a photocopier. Since, however, a high resolution is not required in the selective regional powdering of printed products and since also the particles to be transferred are far larger than toner particles, cheaper materials can be used for the photoconductive layer 146 than for photoconductor drums.

In the further modified illustrative embodiment shown in FIG. 9, the support roller 32 has been replaced by a second application roller 38' of a powder application head 30' that is symmetrical to the powder application head 30. In that manner, the printed products can be evenly powdered from both sides.

I claim:

1. Apparatus for powdering printed products in a printing machine through which the printed products are moved by gripper rods (24) comprising:

a flexible conveyor (22), gripper rods (24) carried by the flexible conveyor (22), a reservoir (68) for powder material, a device (70) for delivering a metered powder stream from the reservoir (68), an application head (30) which applies the metered powder stream to the printed products moved past it, the metered powder stream being distributed over the width of the printed products, the application head (30) having an application roller (38), a powder feeding element (62, 144) cooperating with the application roller (38) and being loaded with the powder stream by the delivery device (70) and distributing the powder stream over the length of the application roller (38), and a support element (32, 38) which supports the reverse sides of the printed products, the circumference of the application roller (38) corresponding to the distance between successive gripper rods (24) on the flexible conveyor (22) and having at least one axial surface recess (52) capable of receiving the gripper rods (24) at least partially, the circumferential surface of the application roller (38) being tangential to the path of the printed products, the powder feeding element (62, 144) being arranged upstream of the nip defined by the application roller (38) and the support element (32, 38') viewed in direction of rotation, the powder material transferred to the printed products being carried by the surface of the application roller (38), and the printed sides of the printed products being in positive mechanical contact with the application roller (38), while being moved between the application head (30) and the support element (32, 38').

2. Apparatus according to claim 1, characterised in that the support element (32; 38') runs at the same speed as the application roller at the passage nip.

3. Apparatus according to claim 1, characterised in that at least the application roller (38), and where applicable the support element (32; 38') also, is rigidly connected to a drive part (56, 58) that cooperates with one of the flexible conveyor means (22).

4. Apparatus according to claim 2, characterised in that the support element (32; 38') is a support roller.

5. Apparatus according to claim 4, characterized in that, the support roller (32; 38') is provided with an axial surface recess (52, 54) in which a gripper rod (24) can be received at least partially, the phase position of support roller (32; 38') and application roller (38) being closely coupled for moving their surface recesses (52, 54) through the passage nip simultaneously with a gripper rod (24).

6. Apparatus according to claim 1, characterized by a suction device and a housing (36) which surrounds the application roller (38), the interior of which housing is connected to the suction device (90, 92).

7. Apparatus according to claim 1, characterized by a housing (36) surrounding the application roller (38) having a coaxial housing wall (82) accompanying the outer surface of the application roller (38) and spaced with a small clearance with respect to the support element (32).

8. Apparatus according to claim 1, characterized by a source of negative pressure (98 to 102), the application roller (38) being hollow and having a circumferential wall (82) made from a material that is permeable to air but impermeable to powder, the interior of the application roller (38) being connected to the source of negative pressure (98 to 102).

9. Apparatus according to claim 1, characterised in that a blowing strip (84) is arranged in the interior of the application roller (38) in the vicinity of the passage nip.

10. Apparatus according to claim 1, characterized by a mixing device (72), wherein the powder feeding element (62) is a nozzle strip connected to the outlet of the mixing device (72) which mixes the metered powder stream produced by the delivery device (70) with a carrier gas stream.

11. Apparatus according to claim 1, characterized in that the powder feeding element is a brush roller, which is loaded with the metered powder stream at a first circumferential portion and contacts the surface of the application roller (38) at another circumferential portion.

12. Apparatus according to claim 1, characterized by a housing (36) surrounding the application roller (38), and a barrier air blowing strip (84) on the housing (36) upstream of the feeding element (62) viewed in the direction of rotation, which produces a radially oriented air curtain.

13. Apparatus according to claim 1, characterised by a feeding electrode (94) which extends in the axial direction of the application roller (38) and a voltage generator (96) one terminal of which is electrically connected to the feeding electrode (94) and the other terminal of which is electrically connected to the application roller (38).

14. Apparatus according to claim 1, characterized by a control unit (106) and a powder release element (44), the powder feeding element (62) and/or the powder release element (44) being arranged at the passage nip and having a plurality of operating segments that are activated independently of one another and actuated by the control unit (106) to dust the printed products with powder only in given regions.

15. Apparatus according to claim 14, characterised in that the control unit (106) comprises a pattern memory (120) which contains the activation signals for the operating segments (66) for one revolution of the application roller (38) and which is addressed in accordance with the instantaneous angular position of the application roller (38).

16. Apparatus according to claim 15, characterized by a sensor strip (108) extending transversely across the path of the printed products and having sensor elements (110) which provide a plurality of measurement signals associated with the ink thickness of the respective transversal regions of the printed product being monitored by the sensor elements (110), and by a read-in control unit for the pattern memory which stores the measurement signals in the pattern memory (120) with addressing of the pattern memory (120) in accordance with the instantaneous angular position of the application roller (38).

17. Apparatus according to claim 16, characterised by a discriminator arrangement (112) which is connected between the outputs of the sensor strip (108) and the pattern memory (120).

18. Apparatus according to claim 14, characterized in that the feeding element (62) has a plurality of operating segments (66) which are activated individually, characterized by a sensor strip (108) having a plurality of sensor elements (110) arranged upstream of the passage nip, which sensor strip provides a plurality of measurement signals associated with the ink thickness of the respective region of the printed product lying in front of the sensor elements, the measurement signals each serving to actuate an associated operating segment (66).

19. Apparatus according to claim 1, characterised in that the support element is formed by a second application head (30'), the first application head (30) and the second application head (30') operating in a functionally identical manner and preferably being constructed symmetrically to the conveying surface of the printed products.

20. Apparatus according to claim 8, wherein the material comprises a sintered material of plastics material.

21. Apparatus according to claim 12, the barrier air blowing strip producing an air curtain that is oriented radially and in the direction of rotation of the roller.

22. Apparatus according to claim 11, wherein the brush roller comprises a magnetic brush roller formed by magnetic particles and a rod-shaped radially magnetized permanent magnet.

23. Apparatus according to claim 18, characterized by a discriminator circuit (112) associated with each of the sensor elements (110) that modifies the measurement signals.

* * * * *